US006254446B1

(12) United States Patent
Thigpen

(10) Patent No.: US 6,254,446 B1
(45) Date of Patent: Jul. 3, 2001

(54) WAKEBOARD FIN

(76) Inventor: Kendon Thigpen, 346 S. 250 West, Providence, UT (US) 84332

( * ) Notice: Subject to any disclaimer, the term of this patent is extended or adjusted under 35 U.S.C. 154(b) by 0 days.

(21) Appl. No.: 09/521,919

(22) Filed: Mar. 9, 2000

(51) Int. Cl.[7] ..... B63B 1/00; B63B 35/00
(52) U.S. Cl. ..... 441/79
(58) Field of Search ..... 114/126, 140, 114/152; 441/65, 74, 79

(56) References Cited

U.S. PATENT DOCUMENTS

| | | | | |
|---|---|---|---|---|
| D. 257,786 | * | 1/1981 | Vann | D21/237 |
| D. 267,666 | * | 1/1983 | Vann | D21/237 |
| D. 291,715 | * | 9/1987 | Alpine | D21/236 |
| D. 307,310 | * | 4/1990 | Bucknell | D21/231 |
| 3,201,807 | * | 8/1965 | Weaver | 441/79 |
| 3,515,089 | * | 6/1970 | Taggart | 114/162 |
| 3,579,681 | * | 5/1971 | Pope, III et al. | 441/79 |
| 4,352,335 | * | 10/1982 | Sugden | 114/143 |
| 4,608,023 | * | 8/1986 | Williams | 441/68 |

FOREIGN PATENT DOCUMENTS

| | | | | |
|---|---|---|---|---|
| 4304158 | * | 8/1994 | (DE) | 441/79 |
| 85/03237 | * | 8/1985 | (WO) | 441/79 |

* cited by examiner

*Primary Examiner*—S. Joseph Morano
*Assistant Examiner*—Andrew Wright
(74) *Attorney, Agent, or Firm*—Steven L. Nichols, Esq.; Parsons Behle & Latimer

(57) ABSTRACT

An improved wakeboard fin unit provides two fins extending from a base portion at an acute angle to each other. A ridge on the base portion runs between the two fins to divert water flow into the fins. The two-fin fin unit provides greater stability for the wakeboard during use and thereby enhances performance.

16 Claims, 2 Drawing Sheets

10
100

100
102
101
104
103

WAKEBOARD FIN

FIELD OF THE INVENTION

The present invention relates to the field of water sports, particularly wakeboarding. More particularly, the present invention relates to the field of wakeboard fins for improved balance and stability.

BACKGROUND OF THE INVENTION

A relatively new, but very popular, watersport is known as wakeboarding. In wakeboarding, the rider secures the wakeboard to his or her feet through the use of bindings, which may include elastic straps or boots. One foot is secured in front of the other so that the rides typically stand sidewise on the board. The rider is then pulled behind a boat or other watercraft, in the same manner as a water-skiier, at such speeds that the wakeboard planes over the surface of the water.

Early wakeboards had a shape very similar to surfboards, with a pointed front end and a more squared back end. Modern wakeboards have eliminated the pointed front end in favor of two symmetrical squared ends. This allows the rider to reverse the orientation of the board with respect to the travel path while performing more complicated tricks during a ride.

To stabilize the board as it skims over the water, a fin is typically added to the underside of the board. The conventional wakeboard fin is a flat fin with a hydrodynamic shape that tapers upward from the underside of the board toward the end of the board. The fin also extends normal to the underside of the board.

On some boards, a second fin, of the same shape as the first, is added to the other end of the board from the first fin. The second fin is usually smaller than the first, and is used to stabilize the board when the rider has reversed the board and is riding the board "backwards," i.e. facing the opposite direction as he or she was initially.

However, conventional wakeboard fins are not entirely satisfactory. Additional stability of the board would make it easier for beginners to learn to wakeboard and for more advance riders to achieve better performance from their boards. Consequently, there is a need in the art for a means of improving the performance of a wakeboard.

SUMMARY OF THE INVENTION

It is an object of the present invention to meet the above-described needs and others. Specifically, it is an object of the present invention to provide a means of improving the performance of a wakeboard. More specifically, it is an object of the present invention to provide an improved wakeboard fin and method of making and using the same that can provide improved wakeboard performance.

Additional objects, advantages and novel features of the invention will be set forth in the description which follows or may be learned by those skilled in the art through reading these materials or practicing the invention. The objects and advantages of the invention may be achieved through the means recited in the attached claims.

To achieve these stated and other objects, the present invention may be embodied and described as a fin unit for stabilizing a board, for example, a wakeboard, traveling over or through water for a rider thereon. In a preferred embodiment, the fin unit includes first and second fins extending at an angle to each other; and a base portion from which the first and second fins extend.

In the preferred embodiment, the base portion is secured to the underside of the wakeboard and the first and second fins extend from the underside of the wakeboard. The angle between the fins is preferably 75 to 85 degrees. Holes are provided in the base portion for securing the fin unit to the board, for example, with one or more set screws.

A ridge may be provided on the base portion running between the first and second fins for deflecting water to the first and second fins when the fin unit travels through water.

The first and second fins and the base portion are preferably manufactured as three separate pieces. In this case, the first and second fins are secured to the base portion with set screws. The base portion may also have first and second grooves defined therein for receiving a base end of the first and second fins, respectively.

The present invention also encompasses the methods of making and using the fin unit described above. For example, the present invention encompasses a method of using a fin unit to stabilize a board traveling over or through water by extending first and second fins at an angle to each other from a base portion secured to an underside of the board so that, as the board moves over or through water, the fin stabilizes the board for a rider thereon.

BRIEF DESCRIPTION OF THE DRAWINGS

The accompanying drawings illustrate the present invention and are a part of the specification. Together with the following description, the drawings demonstrate and explain the principles of the present invention.

DETAILED DESCRIPTION OF THE PREFERRED EMBODIMENTS

Using the drawings, the preferred embodiments of the present invention will now be explained.

Figure 1:
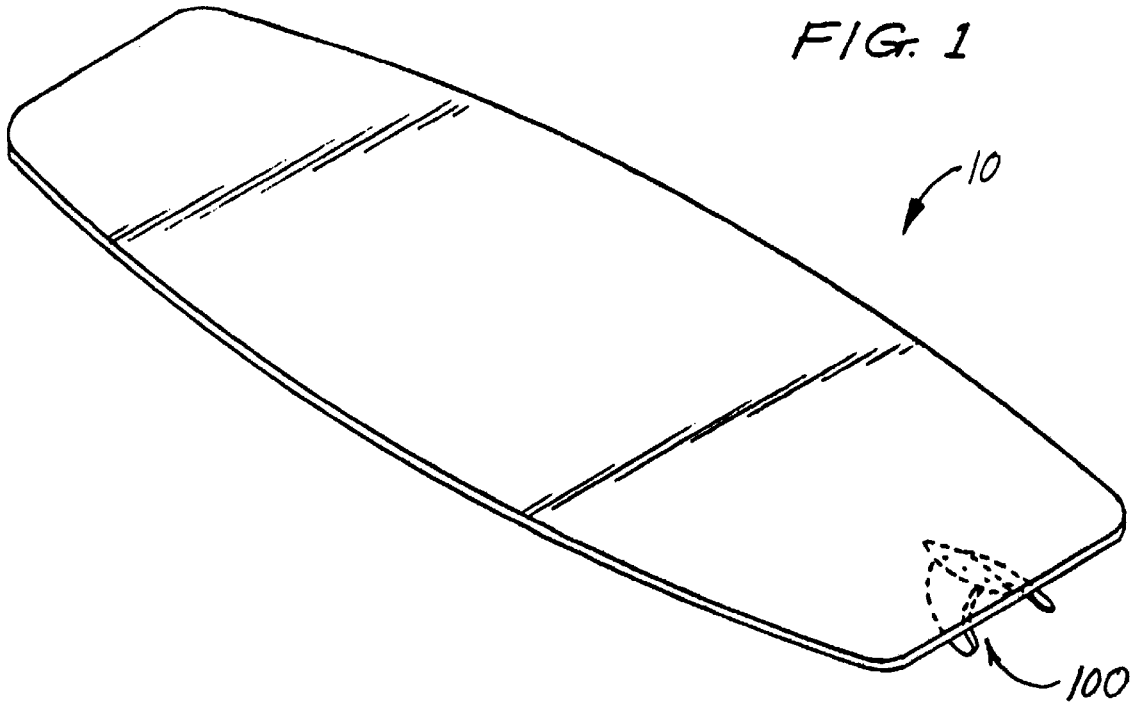
FIG. 1 is an illustration of a wakeboard that incorporates the improved wakeboard fin of the present invention.

As shown in FIG. 1, the present invention includes a novel wakeboard fin (100) which is secured to the underside of a wakeboard (10) to stabilize the path of the board (10) as it is pulled through the water by a boat or other watercraft. The fin (100) also serves to increase the performance of the board (10), making the board (10) more responsive to the shifting weight of a rider standing thereon. In this way, the rider can guide the board (10) to control its path relative to the wake of the craft pulling the rider.

The fin (100) of the present invention is a departure from traditional wakeboard fins. Specifically, the fin (100) of the present invention provides two fins which extend from a base portion preferably at an acute angle with respect to each other and the underside of the board (10). The structure of the fin (100) will be described in detail below. As shown in FIG. 1, the fin (100) is secured near a rear edge of the underside of the wakeboard (10).

Figure 2:
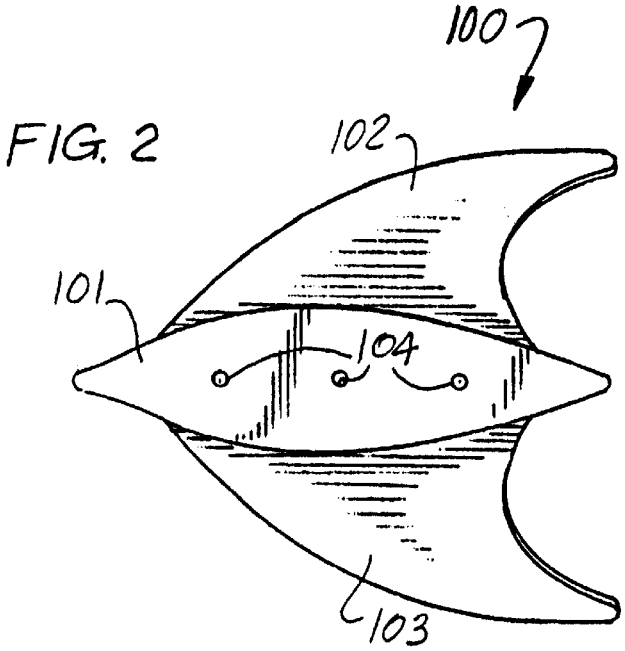
FIG. 2 is an illustration of the underside of a wakeboard fin according to the present invention.

FIG. 2 illustrates a view of a wakeboard fin (100) according to the present invention that is not attached to a wake board. As shown in FIG. 2, a right fin (102) and a left fin (103) extend at an angle to each other from a base portion (101). The length of the base portion is, for example, 4.25 inches. The fins (102, 103) are symmetrical with each other as to both shape and orientation. The height of the fins (102, 103) from the base portion (101) is preferably 2.5 inches.

The surface of the base portion (101) pictured in FIG. 2 is the surface that abuts the underside of the wakeboard when the fin unit (100) is attached thereto. The base portion (101) also has a number of threaded holes (104) provided into which screws (not shown) can be driven to secure the fin unit (100) to the underside of a wake board.

Three holes (104) are illustrated in FIG. 2. However, conventional wakeboards usually provide only two holes for securing a fin. These holes typically correspond to the two outside holes in the illustrated three-hole arrangement. Consequently, a fin unit (100) of the present invention could be easily secured to a conventional wakeboard having only two holes provided therein. This is accomplished by driving two set screws through the corresponding outside holes in the fin unit (100) and board, while omitting or ignoring the central hole pictured in FIG. 2. The preferred spacing is 0.75 inches between holes (104).

Some wakeboards have three holes corresponding to the three holes pictured in FIG. 2. However, only the central hole is threaded for a set screw. For mounting the fin (100) of the present invention to such a board, screws are seated in the two outside holes of the base portion (101). These screws, when seated, have heads that protrude from the base potion (101) of the fin (100). These protruding heads are mated respectively into the outside holes of the three holes in the wakeboard, but are not threaded therein. A set screw is then used through the central hole in both the wakeboard and base portion (101) to secure the fin (100) to the board. The prodtruding heads of the outside screws prevent the fin (100) from pivoting about the central set screw.

Figure 3:
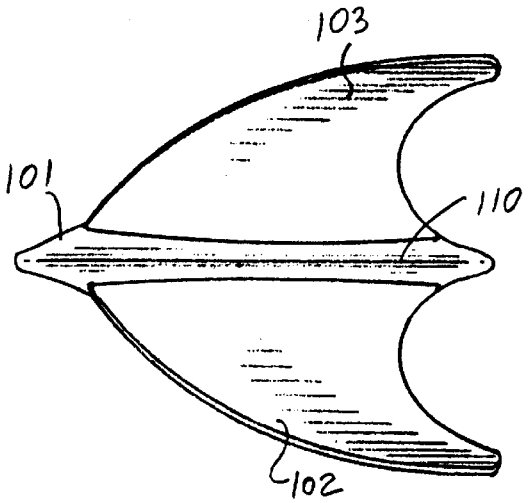
FIG. 3 is an illustration of the underside of a wakeboard fin according to the present invention.

FIG. 3 illustrates an opposite view of the fin unit (100) as shown in FIG. 2. In other words, the view of the fin unit (100) shown in FIG. 2 is what would be seen of the fin (100) when secured to the underside of a wakeboard. The left and right fins (102, 103) extend at angles from the base portion (101) as described above.

As shown in FIG. 3, the fin unit (100) of the present invention may also include a protruding ridge (110) that runs along the base portion (101) between the left and right fins (102, 103). This ridge (110) is also pictured in FIG. 6 and will be described in detail below.

The fin unit (100) of the present invention can be formed as a single integral unit by, for example, injection molded plastic or fiberglass composite material. However, due to the complex shape of the unit (100) casting a mold may present substantial difficulty. Consequently, a preferred embodiment of the fin unit (100) is illustrated in FIG. 4.

Figure 4:
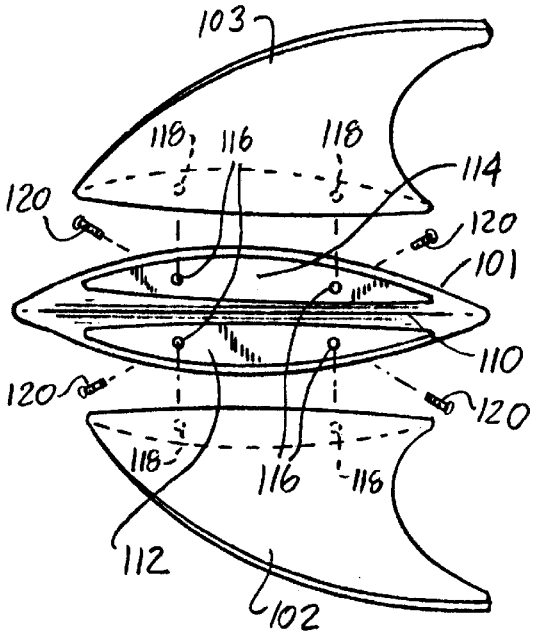
FIG. 4 is an exploded view of a preferred embodiment of a wakeboard fins according to the present invention.

As shown in FIG. 4, the fin unit of the present invention can be formed as three separate pieces that are assembled to form the completed unit. The three separate pieces of the assembly are, the base unit (1010, the right fin (102) and the left fin (103). Grooves (112, 114) are formed along opposite edges of the base portion (101).

The broad or base edges of the left and right fins (102, 103) are then placed in their respective grooves (112, 114). The grooves (112, 114) are given sufficient depth and shape to support the respective fins (102, 103) in their desired orientation. The interface between the grooves (112, 114) and the fins (102, 103) may be a tongue-in-groove joint.

The base unit (101) also comprises additional holes (116) through which set screws (120) are driven. The set screws (120) extended into corresponding holes (118) in the left and right fins (102, 103) to secure the fins (102, 103) to the base portion (101). FIG. 4 illustrates two set screws (120) securing each fin (102, 103) to the base portion (101). However, a single screw or three or more set screws could be used within the scope of the present invention.

Figure 5:
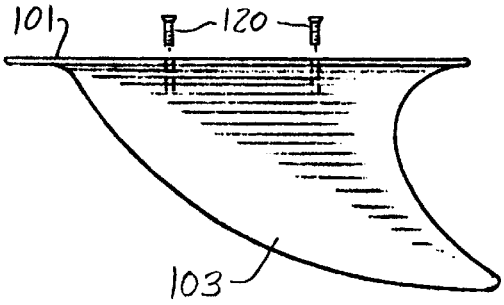
FIG. 5 is a side view of the wakeboard fin shown in FIG. 4.

FIG. 5 illustrates a side view of the three-piece fin unit being assembled. As shown in FIG. 5, the set screws (120) are driven through the base portion (101) and into the respective fins (103, in FIG. 5).

Figure 6:
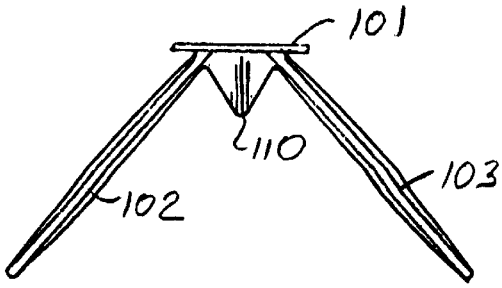
FIG. 6 is a rear view of a wakeboard fin according to the present invention.

FIG. 6 provides an end-on view of the fin unit of the present invention. As shown in FIG. 6, the left and right fins (102, 103) extend from the base portion (101) at an angle. Preferably, the angle between the two fins (102, 103) is an acute angle of, for example, 75 to 85 degrees.

The ridge (110) protrudes from the base portion (101) between the two fins (102, 103) and runs along the length of the fin unit. The ridge (110) is preferably hydrodynamic in shape, meaning that it widens at the center and narrows along its length in either direction to a point. The ridge (110) may also be shorter at the ends and taller in the middle of its length.

The purpose of the ridge (110) is to divert water flowing between the fins (102, 103) into contact with the fins (102, 103). This allows the fins (102, 103) to provide even greater stabilization of the board (10) as it moves through the water.

The preceding description has been presented only to illustrate and describe the invention. It is not intended to be exhaustive or to limit the invention to any precise form disclosed. Many modifications and variations are possible in light of the above teaching.

For example, the precise size and shape of the various components of the fin unit of the present invention can be adapted to the tastes and needs of individual riders. Additionally, the fin unit of the present invention need not be used on wakeboards only, but may equally well provide stability on other boards used in the water such as surfboards and kneeboards. Other uses of the fin unit of the present invention will be learned by those skilled in the art through practicing the principles of the disclosed invention.

The preferred embodiment was chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. A fin unit for stabilizing a board traveling over or through water for a rider thereon, the fin unit comprising:

first and second fins extending at an angle to each other;

a base portion from which said first and second fins extend; and a ridge on said base portion running length-wise between said first and second fins, wherein said first and second fins extend further from said base portion than does said ridge;

wherein said first and second fins and said base portion are three separate pieces;

wherein said first and second fins are secured to said base portion; and wherein said base portion comprises first and second grooves defined therein for receiving a base end of said first and second fins, respectively.

2. The fin unit of claim 1, wherein said angle between said fins is 75 to 85 degrees.

3. The fin unit of claim 1, wherein said ridge on said base portion extends furthest from said base portion at a middle of a length of said ridge, said ridge decreasing in profile toward either end of said ridge from said middle of said ridge along said length of said ridge.

4. The fin unit of claim 1, wherein said base portion comprises holes therethrough for securing said fin unit to said board.

5. A combination of a wakeboard and a fin unit for stabilizing the wakeboard traveling over or through water for a rider thereon, the fin unit comprising:

first and second fins extending at an angle to each other;

a base portion from which said first and second fins extend, and a ridge on said base portion running length-wise between said first and second fins, wherein said first and second fins extend further from said base portion than does said ridge, wherein said base portion is secured to an underside of said wakeboard and said first and second fins extend from said underside of said wakeboard.

6. The combination of claim 5, wherein said first and second fins and said base portion are three separate pieces.

7. The combination of claim 6, wherein said first and second fins are secured to said base portion with set screws.

8. The combination of claim 7, wherein said base portion comprises first and second grooves defined therein for receiving a base end of said first and second fins, respectively.

9. A method of using a fin unit to stabilize a board traveling over or through water, said method comprising:

extending first and second fins at an angle to each other from a base portion secured to an underside of said board so that, as said board moves over or through water, said fin stabilizes said board for a rider thereon;

extending a ridge from said base portion running length-wise between said first and second fins; and extending said first and second fins further from said base portion than said ridge.

10. The method of claim 9, further comprising disposing said fins at an angle from 75 to 85 degrees.

11. The method of claim 9, further comprising deflecting water to said first and second fins when said fin unit travels through water with said ridge on said base portion running between said first and second fins.

12. The method of claim 9, further comprising forming said first and second fins and said base portion as three separate pieces.

13. The method of claim 12, further comprising securing said first and second fins to said base portion with set screws.

14. The method of claim 13, further comprising seating a base end of said first and second fins in respective grooves formed in said base portion.

15. The method of claim 9, further comprising securing said fin unit to said board with one or more set screws disposed through holes in said base portion.

16. The method of claim 9, further comprising securing said fin unit to a wakeboard.

* * * * *